US007140441B2

(12) United States Patent
Hauge et al.

(10) Patent No.: US 7,140,441 B2
(45) Date of Patent: Nov. 28, 2006

(54) FLUID SEPARATION METHOD AND SYSTEM

(75) Inventors: Espen Hauge, Oslo (NO); Øystein Grande, Lysaker (NO)

(73) Assignee: Vetco Aibel AS, Billingstad (NO)

( * ) Notice: Subject to any disclaimer, the term of this patent is extended or adjusted under 35 U.S.C. 154(b) by 288 days.

(21) Appl. No.: 10/695,647

(22) Filed: Oct. 29, 2003

(65) Prior Publication Data

US 2004/0140099 A1 Jul. 22, 2004

(30) Foreign Application Priority Data

Oct. 29, 2002 (NO) ..... 20025187

(51) Int. Cl.
*E21B 43/36* (2006.01)
*B01D 45/02* (2006.01)

(52) U.S. Cl. ..... 166/357; 166/267; 210/805; 210/806; 210/195.1; 210/253; 210/254; 95/253; 96/183

(58) Field of Classification Search ..... 166/357, 166/267; 210/767, 806, 805, 188, 194, 195.1, 210/252–255; 95/253; 96/182, 183
See application file for complete search history.

(56) References Cited

U.S. PATENT DOCUMENTS 2,773,556 A * 12/1956 Banks et al. ..... 96/162
4,032,439 A * 6/1977 Oldham ..... 210/618
5,009,680 A 4/1991 Brekke
5,090,498 A * 2/1992 Hamill ..... 175/206
5,302,294 A * 4/1994 Schubert et al. ..... 210/702
5,693,225 A 12/1997 Lee
6,197,095 B1 3/2001 Ditria et al.
6,315,813 B1 * 11/2001 Morgan et al. ..... 95/23
6,872,239 B1 * 3/2005 Nilsen et al. ..... 95/30
6,907,933 B1 * 6/2005 Choi et al. ..... 166/357
2005/0005772 A1 * 1/2005 Spani ..... 96/200

FOREIGN PATENT DOCUMENTS

GB 2224220 A 5/1990
GB 2258167 A 2/1993
NO 173838 2/1994
WO WO 9641065 A1 12/1996
WO WO 02092965 A1 11/2002

* cited by examiner

*Primary Examiner*—Kenneth Thompson
(74) *Attorney, Agent, or Firm*—Venabe LLP; Eric J. Franklin

(57) ABSTRACT

A method and a system for separating the phases of a multiphase fluid from one or more wells. The system includes at least one first gravity separator and at least one second gravity separator, and elements for conducting the fluid from the well or wells to the first and second gravity separator(s). The system includes elements for selectively conducting the fluid to the first and second gravity separators either in parallel or in subsequent steps depending on the properties of the well fluid and process conditions.

20 Claims, 3 Drawing Sheets

FLUID SEPARATION METHOD AND SYSTEM

TECHNICAL FIELD

The present invention relates to a method for separation of the phases of a multiphase fluid from one or more wells, in which a multiphase fluid is conducted to an equipment for the separation of different phases in the fluid from each other.

The invention also relates to a system for separating the phases of a multiphase fluid from one or more wells, comprising at least one first gravity separator and at least one second gravity separator, and a means for conducting the fluid from the well or wells to the first and second gravity separator(s).

Since the invention is particularly advantageous in subsea applications in which the system is a subsea system, the invention will be described by way of example with reference to such a subsea application. However, it should be understood that the present invention is not limited to such a subsea system, but is also applicable to e.g. offshore topside systems as well as land-based systems.

BACKGROUND OF THE INVENTION

In recent years, the oil and gas industry has found significant oil and gas reserves in deepwater offshore locations. The subsea technology of today has limitations when it is deployed at these water depths. At these water depths the compactness of the equipment used is critical during installation and maintenance thereof. A compact system will ease the installation process and lower the installation costs since smaller installation vessels can be deployed. The maximum weight for a single lift is decreasing with increasing water depth and some equipment that could be used at shallower water depths will be impossible to install due to their weight and size (typically large gravity separators).

Numerous solutions to deal with the weight and size limitations of gravity separators have been suggested based on other and more compact technologies than gravity separation. Some of these technologies come to short when it comes to reliability and failure rates. For instance, cyclone technology alone may fulfill the compactness requirements, but will have difficulties to meet the important reliability criteria as to dealing with e.g. variations in process conditions.

Thus, the use of gravitational settling by means of gravity separators, in combination with or in addition to supplementing techniques such as hydro cyclones, electrostatic coalescers, etc may be regarded as the most efficient and reliable way in order to achieve sufficient separation of oil from water, gas and possible solid particles, such as sand, at large water depths as well as on the surface or on land.

PRIOR ART

U.S. Pat. No. 6,197,095 discloses a subsea system and method by means of which the weight and size of the gravity separator used is minimized. In particular there is presented a system of a modular construction that is adapted to perform any out of five different, basic process steps when separating oil from the rest of a multiphase fluid, namely cyclonical removal of solids, cyclonical removal of bulk gas, pre-separation of the fluid by means of a liquid/liquid hydrocyclone, gravitational settling by means of a gravity separator, and, finally, polishing or clean up of water obtained as a separation product from the gravity separator.

Thanks to the order and presence of the other four steps than the gravity separator step, the gravity separator can be greatly reduced in size with respect to flow rate.

However, a further reduction of the size and weight of the gravity separator or separators used in the process would be advantageous.

THE OBJECT OF THE INVENTION

Therefore, it is an object of the present invention to present an improved system and method that has a high degree of compactness, operative flexibility, reliability and robustness, and redundancy e.g. in case that a gravity separator need to be subjected to service or maintenance.

Another object of the present invention is to permit use of the same basic element(s), of the system selectively, based on process conditions and properties of the multiphase fluid, preferably with as little intervention activity as possible.

Yet another object of the invention is to minimize the need of large and expensive intervention activities by permitting the gravity separators of the system to be designed as to their size and weight depending on the capacity of available intervention vessels for the actual water depth.

SUMMARY OF THE INVENTION

The main object of the invention is achieved by means of the initially defined method, characterized in that the fluid is selectively conducted to at least one first and at least one second gravity separator in parallel or in subsequent steps depending on the properties of the fluid and process conditions.

According to a preferred embodiment of the inventive method, the multiphase fluid is conducted to one first gravity separator or to a group of first gravity separators connected in parallel, in order to be subjected to a first gravitational settling step, and that one of the separation products of that step is conducted to a second gravity separator or group of second gravity separators connected in parallel, in order to be subjected to a second gravitational settling step.

According to yet another preferred embodiment of the inventive method, out of a plurality of three or more gravity separators, based on process conditions and properties of the multiphase fluid, one or more separators are selected to become said first separator or separators, the remaining separator or separators being utilized as said second separator or separators.

Preferably, said separation product of the first gravitational settling step is subjected to an emulsion-breaking treatment other than gravitational settling before being subjected to the second gravitational settling step. Preferably, said emulsion-breaking treatment other than gravitational settling comprises treatment by means of an electrostatic coalescer, preferably a compact electrostatic coalescer.

The main object of the invention is also achieved by means of the initially defined system, characterized in that it comprises means for selectively conducting the fluid to the first and second gravity separator(s) either in parallel or in subsequent steps.

According to a preferred embodiment of the inventive system, the system comprises at least three gravity separators and means for selectively connecting at least one of the gravity separators such that it either belongs to a group of first gravity separators or a group of second gravity separators.

Preferably, the system according to the invention comprises an emulsion-breaking unit that is arranged in series with the first and second gravity separator(s). Advantageously the system comprises means for connecting the emulsion-breaking unit in series with and downstream the first gravity separator or group of first gravity separators and upstream the second gravity separator or group of second gravity separators. The system should also comprise means that permit the emulsion-breaking unit to be located upstream all gravity separators if required.

According to a preferred embodiment, the system comprises a plurality of gravity separators, a corresponding plurality of first conduits leading from the well to each of the gravity separators, and valve means for controlling the flow through each individual conduit to the gravity separator associated thereto, and a circuit comprising a conduit leading from an outlet of a first separator to an inlet into a second separator, for conducting one of the separation products of the first separator to the second separator, and a valve for controlling the flow of said separation product to the second gravity separator.

Preferably, the system comprises a plurality of conduits, one for each gravity separator, leading from an outlet of the associated separator to an inlet of each one of the other ones of the plurality of separators, for conducting a separation product to any one of the other separators of the plurality of separators, and a plurality of valves for controlling the flow of said separation product to each individual or a group of the separators.

Further developments of the inventive system are defined in the dependent claims 15–20.

Further features and advantages of the present invention will also be presented in the following description.

BRIEF DESCRIPTION OF THE DRAWINGS

A preferred embodiment of the invention will now be described by way of example with reference to the annexed drawings, on which

DETAILED DESCRIPTION OF THE INVENTION

Figure 1:
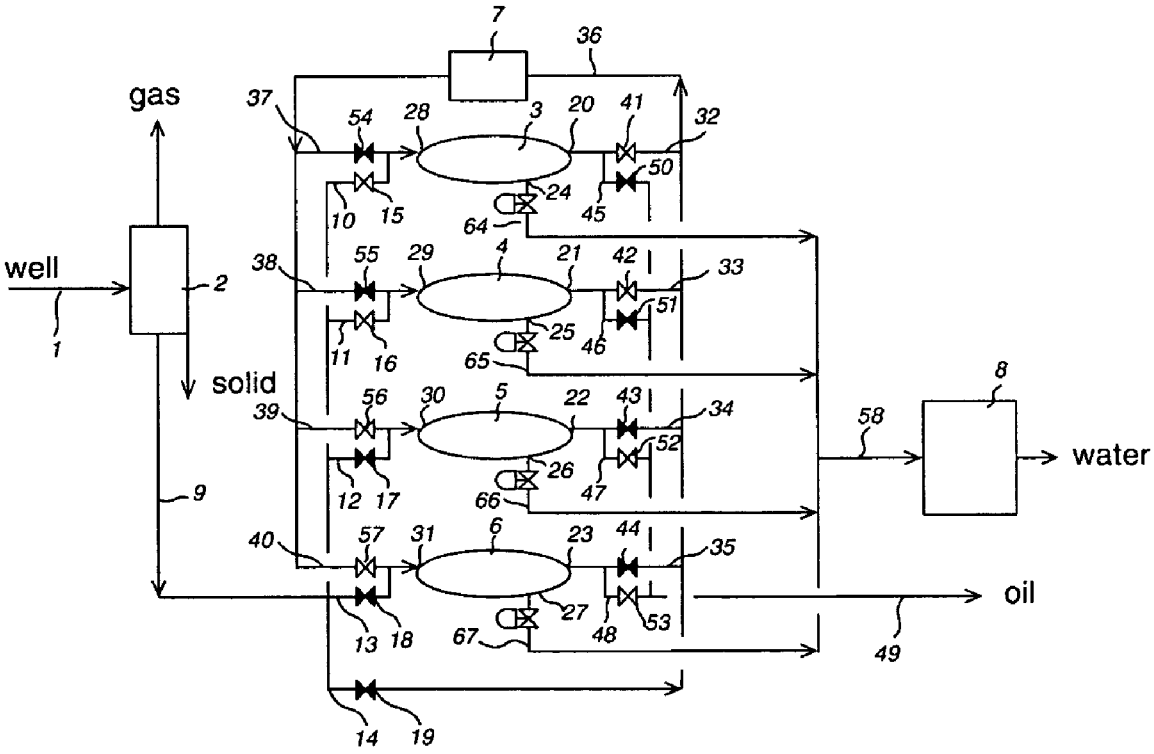
FIG. 1 is a schematic diagram of a system according to one embodiment of the invention, with control valves arranged according to one possible operation mode of the system.

In FIG. 1 there is shown a schematic diagram of a system according to one embodiment of the invention. The system is a subsea system arranged at the seabed. The system comprises a pipe 1 or the like that conducts a multiphase fluid from one or more wells (not shown) in an oil field, a first separator 2, for example a cyclone, for separating gas and/or solid particles from the fluid, a set of, here four, liquid/liquid gravity separators 3,4,5,6, an emulsion-breaking unit 7, and a water polishing unit 8. Each of the above-mentioned separation steps preferably consists of modular elements that interact with each other to meet a desired separation specification.

The system also comprises a conduit 9 that leads from a liquid, here oil-water emulsion, outlet of the cyclone separator 2 and splits up into a plurality of branches or conduits 10–13 that lead to an inlet of a respective gravity separator 3–6. Yet another branch or conduit 14 leads from the common conduit 9 to the emulsion-breaking unit 7.

In each of the branches or conduits 10–14 there is provided a control valve 15–19 by means of which the flow of the fluid can be individually controlled from a remote location, for example from above the sea surface. Preferably, all valves included in the system, not only valves 15–19, should comprise a drive means such as an electric motor or the like and be operatively connected to a remote control unit or station. However, the drive means may also comprise hydraulic actuators, and the invention is not necessary limited to remote control of the said drive means. ROV and diver operated valves might also be used.

Each separator 3–6 is provided with at least two outlets for extraction of two different separation products, here a water phase and an oil phase. In FIG. 1 the oil-phase outlets are indicated with 20–23 and conduct the oil-phase further via conduits 32–35 respectively, while the water-phase outlets are indicated with 24–27 and conduct the water-phase further via conduits 64–67 respectively.

The system comprises a connection between each of the oil-phase outlets 20–23 and each of the opposite inlets 28–31 of the separators 3–6. In this way each of the separators 3–6 is connected via its oil-phase outlet and the emulsion-breaking unit 7 to each one of the remaining separators 3–6. The connection is formed by a plurality of conduits 32–35 leading from a respective separator outlet 20–23 and united into one single conduit 36, in or on which the emulsion-breaking unit 7 is arranged. Downstream the emulsion-breaking unit 7 the common conduit 36 splits up into a plurality of conduits or branches 37–40 that lead to a respective separator inlet 28–31. Here, the conduit 14 leading directly from the cyclone separator 2 to the emulsion-breaking unit 7 is connected to and merges with the common conduit 36 upstream the emulsion-breaking unit 7.

Each of the conduits 32–35 leading from the oil-phase outlets 20–23 is provided with a valve 41–44 for controlling the flow of fluid through the conduit in question.

In parallel with the conduits 32–35 each separator is provided with a conduit 45–48 for conducting the oil phase away from the gravity separators 3–6. Conduits 45–48 are arranged as branches from conduits 32–35 and connected to the latter upstream valves 41–44. The conduits 45–48 may, as suggested here, be united to one single conduit or pipe 49 that leads to any subsequent location, for example to any on-shore location for further treatment or storage of the oil. In a corresponding way, the conduits 54–57 may, as suggested here, be united to one single conduit or pipe 58 that leads whenever applicable to the water polishing unit 8 as shown in the figures.

Each of the above-said conduits 45–48 is provided with a valve 50–53 for controlling the flow of the fluid through the conduit 45–48 in question. In a corresponding way, each of the conduits 64–67 is provided with a valve as for example shown in the figures.

Each of the conduits 37–40 that lead to a respective separator inlet 28–31 is provided with a valve 54–57 for directing and/or controlling the flow of fluids through each conduit 37–40.

In FIG. 1 the valves of the system are controlled and set such that a parallel flow of fluid is permitted from the well and the first separator 2 directly into a first and a second gravity separator 3,4, while the fluid is prevented from flowing directly into a third and fourth separator 5,6. Neither is any flow permitted via conduit 14 directly to the emulsion-breaking unit 7 as valve 19 is kept closed.

However, the oil-phase obtained at the outlets 20,21 of the first and second separator 3,4 is permitted to flow through conduits 32, 33 and common conduit 36 to and through the emulsion-breaking unit 7 and, via the conduits 39,40 and inlets 30,31 into the third and fourth gravity separators 5,6 for the purpose of being subjected to a second gravitational settling step.

From the remaining third and fourth gravity separator 5,6 the oil-phase is permitted to flow via conduits, 47, 48 and 49 to any subsequent location. It should be stated that all valves except the ones permitting the flows indicated above should be closed in order to prevent other flows than these during the operation mode shown in FIG. 1 and described here.

It should be understood that, when, as in this embodiment, four gravity separators 3–6 are used, a plurality of operation modes are possible by control of the operation of the individual valves. The 2+2 mode has just been described, in which the fluid is subjected to a first gravitational settling step in two first gravity separators 3,4, and then subjected to a second gravitational settling step in the following two gravity separators 5,6. Other possible modes are 0+4, 1+3, 3+1 and 4+0, achieved through appropriate control of the valves of the system. As a result of the different operation modes the emulsion-breaking unit 7 will be located either upstream or downstream in the system with regard to the gravitational sedling steps and individual gravity separators 3–6. For the 4+0 mode the emulsion-breaking unit 7 is not used at all in the process. For the 0+4 mode on the other hand, the fluid is conducted via valve 14, conduits 19 and 36, and through the emulsion-breaking unit 7 before being introduced into all four separators 3–6 in parallel. The gravity separator(s) may also include coalescing internals that may replace or improve the emulsion-breaking unit 7. It should be emphasized that the separators of each individual gravitational settling step are arranged in parallel while the separators of different gravitational settling steps are arranged in series.

Figure 2:
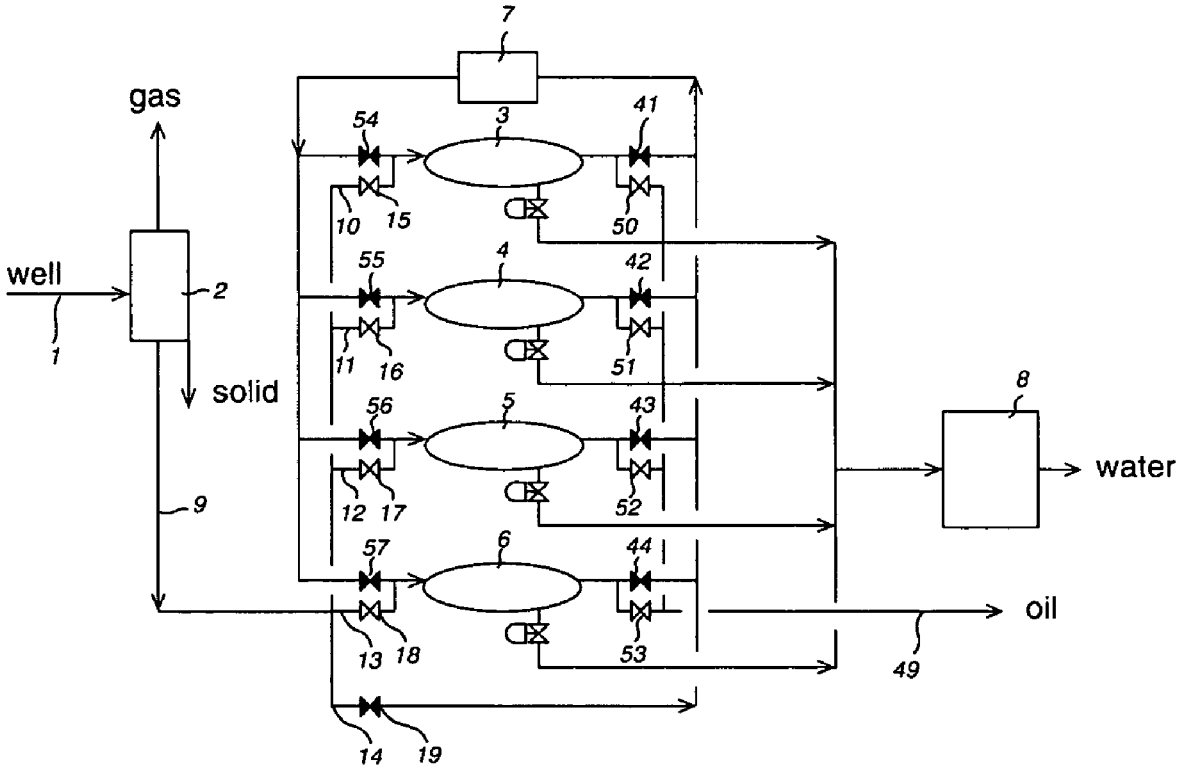
FIG. 2 is a schematic diagram corresponding to the one in FIG. 1, but with its control valves arranged according to a possible second operation mode.

In FIG. 2 a system in the 4+0 mode is shown as an example of a mode other than the 2+2 mode shown in FIG. 1 and described above. In FIG. 2 inlet valves 15–18 are all open while outlet valves 41–44 are closed and outlet valves 50–53 are all open. Accordingly all separators are arranged in parallel for performing the same gravitational settling step in parallel.

Figure 3:
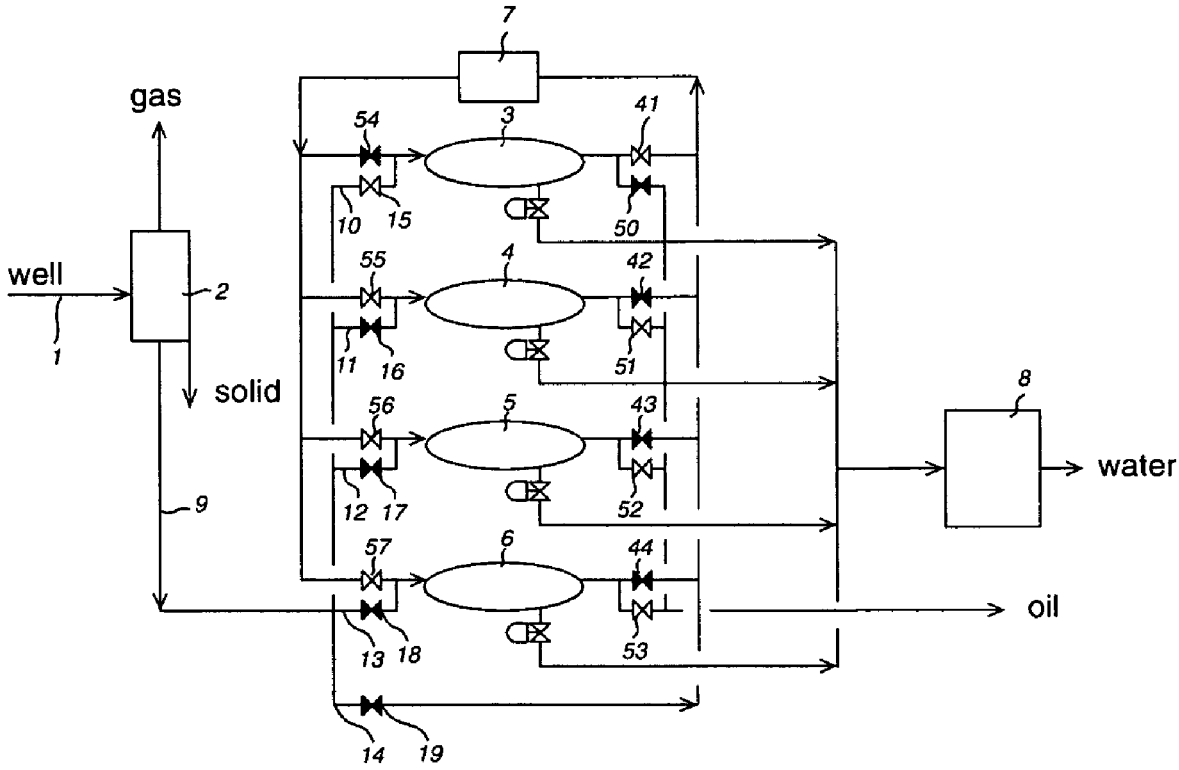
FIG. 3 is a schematic diagram corresponding to the ones in FIGS. 1 and 2, by showing a third operation mode of the inventive system.

FIG. 3 shows the 1+3 mode. In FIG. 3 inlet valve 15 and outlet valve 41 of first separator 3 are open, while inlet valves 16–18 and outlet valves 42–44 of second to fourth separators 4–6 are closed. Outlet valves 51–53 of second to fourth separators 4–6 are open. Accordingly, first separator 3 is arranged in series with second to fourth separators 4–6, that are arranged in parallel with each other. First separator 3 performs a first gravitational settling step while second to fourth separators 4–6 perform a second gravitational settling step.

It should be understood that the different modes mentioned above can be achieved also in the case when the emulsion-breaking unit is omitted.

For a system that comprises only two gravity separators, the possible modes will, accordingly, be 2+0, 1+1 and 0+2. Such a smaller system is also within the scope of the invention, though not here shown by a specific embodiment. It should also be understood that, in a system comprising a plurality of gravity separators, the design of the system permits one or more separators to be retrieved, for example for maintenance and repair. Accordingly, a system comprising four or more gravity separators could as well operate in any mode comprising less than four separators. With the inventive design of the system it is also possible to choose which out of two gravity separators that are connected in series will be the upstream one and which will be the downstream one, by means of valve control.

It should be stated that the different operation modes are selected based on well stream characteristics and process conditions, including the fluid properties such as the water content (water cut), flow rate, etc. For example, at the end of the oil-field life, when the water cut is higher than before and the fluid reaching the gravity separators is water-continuous, the separators 3–6 can be used as single stage gravity separators, that is according to the 4+0 mode without use of the emulsion-breaking unit 7. The application or omission of said unit 7 also depends on the specific fluid properties and process separation conditions, which might differ from well to well and also during the lifetime of a single well.

In other cases, such as when the water received as a separation product from the gravity separators is very clean from oil, the water polishing unit 8 may be omitted. Correspondingly, the separator 2 may be omitted if the gas-oil ratio is low, and solid particle separation in separator 2 may be omitted if the solid content in the fluid is low. Thus, the invention provides possibilities to selectively choose which operation mode should be used as the most suitable one based on the prevailing process conditions.

It should be understood that the number of gravity separators in the system can be varied, from two and up to as many as required under the specific conditions. Therefore, the invention shall not be restricted to the number of gravity separators described above, even though this might be the preferred number for most applications at the moment. It should also be noted that all gravity separators are completely interchangeable, which adds redundancy to the system. Further, it should be emphasized that the basic element (s) or separation steps of the system preferably are built as modular elements, which interact with each other to meet the desired separation specification. Further, the invention makes it possible to use the same equipment module for different purposes depending on the well stream characteristic without any or with minimum intervention activities.

It should also be understood that further alternative embodiments will be obvious for a man skilled in the art without thereby departing from the scope of protection claimed in the appended patent claims supported by the description and the annexed drawings.

Finally, it should be emphasized that the inventive arrangement of the gravity separators, conduits and valves makes it possible to use a plurality of relatively compact gravity separators each of which is suitable for use at large water depths. The system is also very flexible in the sense that, by way of valve control, it will facilitate maintenance and repair work, as it permits one or more of the separators to be removed independently of the other(s) while still having the remaining separators in operation.

The invention claimed is:

1. A method for separation of the phases of a multiphase fluid from one or more wells, the method comprising:

conducting a multiphase fluid to a plurality of gravity separators for separation of different phases in the fluid from each other, wherein the fluid is conducted to at least one first and at least one second gravity separator simultaneously or sequentially depending on properties of the well fluid and process conditions.

2. The method according to claim 1, further comprising:

conducting the multiphase fluid to one first gravity separator or to a group of first gravity separators connected in parallel, thereby subjecting the multiphase fluid to a first gravitational settling step, and conducting one of the separation products of that step to a second gravity separator or group of second gravity separators connected in parallel, thereby subjecting the one of the separation products to a second gravitational settling step.

3. The method according to claim 1, further comprising:

selecting one or more separators out of a plurality of three or more gravity separators, based on process conditions and properties of the multiphase fluid, to become said first separator or separators, and utilizing the remaining separator or separators as said second separator or separators.

4. The method according to claim 1, further comprising:

subjecting said separation product of the first gravitational settling step to an emulsion-breaking treatment other than gravitational settling before subjecting the separation product to the second gravitational settling step.

5. The method according to claim 4, wherein said emulsion-breaking treatment other than gravitational settling comprises treatment by means of an electrostatic coalescer.

6. The method according to claim 1, further comprising:

subjecting the multiphase fluid to a treatment for removal of gas and/or solid particles before subjecting the multiphase fluid to the gravitational settling in the gravity separators.

7. The method according to claim 1, wherein the multiphase fluid delivered to the first and second gravity separators comprises an oil phase and a water phase, and wherein the separation product conducted from the first gravity separator or group of first gravity separators to the second gravity separator or group of second gravity separators is the oil-richest phase obtained by the gravity settling in the first separator or separators.

8. A system for separating the phases of a multiphase fluid from one or more wells, comprising:

at least one first gravity separator, at least one second gravity separator, and means for conducting the fluid from the one or more wells to at least one first gravity separator and at least one second gravity separator, simultaneously or sequentially depending on properties of the well fluid and process conditions.

9. The system according to claim 8, further comprising:

at least three gravity separators, and means for selectively connecting at least one of the at least three gravity separators such that it either belongs to a group of first gravity separators or a group of second gravity separators.

10. The system according to claim 8, further comprising:

means for connecting the individual gravity separators of a group of first separators or a group of second separators in parallel with each other.

11. The system according to claim 8, further comprising:

an emulsion-breaking unit that is arranged in series with at least one of the first and the second gravity separator.

12. The system according to claim 11, further comprising:

means for connecting the emulsion-breaking unit in series with and downstream the first gravity separator or group of first gravity separators and upstream the second gravity separator or group of second gravity separators.

13. The system according to claim 8, further comprising:

a plurality of gravity separators, a corresponding plurality of first conduits leading from the one or more wells to each of the gravity separators, a valve means for controlling the flow through each individual conduit to the gravity separator associated thereto, a circuit comprising a conduit leading from an outlet of a first gravity separator to an inlet into a second gravity separator, for conducting one of the separation products of the first gravity separator to the second gravity separator, and a valve for controlling the flow of said separation product to the second gravity separator.

14. The system according to claim 13, further comprising:

a plurality of conduits, one for each gravity separator, leading from an outlet of the associated separator to an inlet of each one of the plurality of separators, for conducting a separation product to any one of the other ones of the plurality of separators, and a plurality of valves for controlling the flow of said separation product to each individual or a group of the separators.

15. The system according to claim 13, wherein said circuit comprises an emulsion-breaking unit, and wherein the separation product conducted therein passes through the emulsion-breaking unit.

16. The system according to claim 14, wherein the plurality of conduits that lead from said outlets of the individual separators are gathered to one single conduit, and wherein there are downstream branches from the single conduit that lead to said inlets of the respective separator.

17. The system according to claim 8, further comprising:

a plurality of valve-operated conduits, one for each of the plurality of separators, that lead from an outlet of said separators to a following, different treatment step other than gravitational settling.

18. The system according to claim 8, further comprising:

at least one separator upstream the set of gravity separators, for the purpose of separating gas and/or solid particles from the multiphase fluid before conducting the latter to the gravity separators.

19. The system according to claim 8, wherein it is a subsea system.

20. The system according to claim 8, wherein the multiphase fluid comprises an oil phase and a water phase that are to be separated from each other in the gravity separators.

* * * * *